United States Patent [19]

Reinhold

[11] 4,278,477

[45] Jul. 14, 1981

[54] METAL TREATMENT

[75] Inventor: Earl R. Reinhold, Levittown, Pa.

[73] Assignee: Amchem Products, Inc., Ambler, Pa.

[21] Appl. No.: 131,609

[22] Filed: Mar. 19, 1980

[51] Int. Cl.[3] ..... C23F 7/00

[52] U.S. Cl. ..... 148/6.14 R; 148/6.15 R; 106/14.12; 106/14.15; 106/14.21; 106/1.27

[58] Field of Search ..... 148/6.15 R, 6.14 R; 106/14.12, 14.15, 14.21, 1.27

[56] References Cited

U.S. PATENT DOCUMENTS

| | | | |
|---|---|---|---|
| 2,766,138 | 10/1956 | Talmey | 427/438 |
| 2,956,900 | 10/1960 | Carlson | 427/438 |
| 3,444,007 | 5/1969 | Maurer et al. | 148/6.15 R |
| 3,515,600 | 6/1970 | Jones et al. | 148/6.15 R |
| 3,745,039 | 7/1973 | Feldstein | 427/305 |
| 3,929,514 | 12/1975 | Houlihan et al. | 148/6.14 R |
| 3,947,610 | 3/1976 | Bodmer et al. | 427/438 |
| 3,962,495 | 6/1976 | Feldstein | 427/306 |

OTHER PUBLICATIONS

Rogers et al., JACS 71 2081–2085 (1949).

*Primary Examiner*—Ralph S. Kendall
*Attorney, Agent, or Firm*—Alexis Barron

[57] ABSTRACT

An aqueous alkaline coating solution having a pH of no greater than about 10.2 for forming on zinc surface a coating which is corrosion resistant and to which overlying coatings adhere excellently is disclosed, and containing in solution one or more of the following metals: cobalt, nickel, iron and tin; and an inorganic complexing material which is effective in maintaining the metal in solution; and optionally, a reducing agent.

18 Claims, No Drawings

METAL TREATMENT

FIELD OF INVENTION

This invention relates to the treatment of metal to modify the surface properties thereof, and more particularly to the treatment of a zinc surface to improve its ability to resist being corroded.

It is known to coat zinc surfaces with aqueous coating solutions that are effective in forming thereon corrosion-resistant coatings which protect the surface from degradation due to attack by materials which tend to corrode the surface. In general, the coatings formed from such coating solutions also should have properties such that overlying coatings which are applied thereto adhere tightly and strongly. Such overlying coatings, which may be decorative or functional in nature, are formed from materials such as paints, lacquers, etc. (referred to hereinafter as "siccative coatings").

Two basic types of compositions used in forming on zinc surfaces coatings which are corrosion-resistant and which adhere well to siccative coatings are acidic compositions, as exemplified by those that form phosphate or chromate coatings on the surface, and alkaline compositions. It is to the alkaline type composition that the present invention relates.

REPORTED DEVELOPMENTS

Alkaline treatment of zinc surfaces is described in U.S. Pat. No. 3,444,007 to Maurer and Shah. This patent discloses an aqueous alkaline coating solution which has a pH preferably greater than about 11, most preferably in the range of 12.6 to 13.3, and which contains an alkali metal ion, and one or more of the following metal ions: silver, magnesium, cadmium, aluminum, tin, titanium, antimony, molybdenum, chromium, cerium, tungsten, manganese, cobalt, ferrous and ferric iron, and nickel. In addition, the aqueous alkaline coating solution contains a complexing agent which complexes the metal ions to keep them in solution. Many complexing agents are disclosed including, for example, cyanides, condensed phosphates, dicarboxylic acids, amino acids, hydroxycarboxylic acids, hydroxyaldehydes, polyhydroxy aliphatic compounds, phenolic carboxylic acids, amine carboxylic acids, polyamino acids, and salts of lower molecular weight lignosulfonic acids. The patent discloses also that alkalinity can be imparted to the solution by the use of materials such as ethanolamines, alkali metal hydroxides, carbonates, phosphates, borates, silicates, polyphosphates and pyrophosphates. There are two main problems encountered in the use of this type coating solution. One is that its high alkalinity creates handling problems, and the other is that there tends to be formed during use sludge which clogs nozzles, pumps, etc.

A modified form of the aforementioned type coating solution is disclosed in U.S. Pat. No. 3,515,600 to Jones and Ellis. This patent discloses that sludge formation can be minimized by including in the solution at least about 0.75 wt.% of phosphate ions. Such solutions nevertheless are highly alkaline.

Another patent which relates to the aforementioned type of coating solution is U.S. Pat. No. 3,929,514 to Houlihan, Newell and La Cosse, which discloses the use of a specific type of complexing agent, namely a water soluble alkanolamine salt to maintain the metal in solution. The patent discloses that the pH of the composition is in the range of 7.5 to 13, preferably 10 to 12.5.

Three of the five compositions shown in the examples of the patent have a pH of 12.2 and the other two have pH's of 11.0 and 11.5. Accordingly, it would appear that highly alkaline compositions are required for practical use.

The present invention relates to aqueous alkaline solutions for imparting to zinc surfaces coatings which are resistant to corrosion and which adhere well to siccative finishes, and solutions which can be used effectively at pH's substantially below those that are used typically in the industry.

BRIEF DESCRIPTION OF THE INVENTION

In accordance with this invention, there is provided an aqueous alkaline treating solution which has a pH of no greater than about 10.2 and which contains, as essential ingredients, one or more of the following metals in solution: cobalt, nickel, iron and tin; and an inorganic or organic complexing material which is effective in maintaining the metal in solution. In addition, the solution can include a reducing agent.

A preferred inorganic complexing material for use in the practice of the present invention is pyrophosphate and a preferred organic complexing material is nitrilotriacetic acid or a salt thereof.

As will be explained in detail below, another aspect of the present invention relates to the use of a replenishing composition for maintaining the effective operation of a coating bath as it is used continuously to coat zinc articles.

A coating solution within the scope of the present invention can be used to treat a zinc surface in a manner such that there is formed on the surface a coating which is corrosion resistant and to which overlying coatings adhere excellently. In addition, the coating solution is effective in forming a coating which is readily visible by virtue of its being colored. This is important because it signals the user that the composition is indeed forming a coating on the surface.

The present development provides several other important advantages. Excellent results can be achieved by the use of a composition which has a substantially lower pH than what the industry has been used to. The lower alkalinity mitigates handling problems and permits the use of conventional containers and other equipment. Also, a bath of the composition can be operated for prolonged periods of time without encountering sludge problems. And, in addition, a bath of the composition can be prepared utilizing a minimum of ingredients.

DETAILED DESCRIPTION OF THE INVENTION

The coating solution of the present invention can be used to coat surfaces of pure zinc or of alloys in which zinc is present in a significant amount, including for example, zinc die castings, hot dipped galvanized and electro-galvanized steel surfaces, a 50/50 Al/Zn alloy and galvanneal. It is believed that one of the widest uses of the coating solution will be in the coating of hot dipped and electro-galvanized steel coil.

The aqueous alkaline coating solution can be prepared from compounds which contain the aforementioned essential ingredients and which are soluble or capable of being solubilized in the solution.

The source of the dissolved or complexed metal (cobalt, nickel, iron and/or tin) can be any compound soluble in the composition. It is preferred that the metal be added in the form of a nitrate, but there may be used also, for example, metal chlorides, sulfates, phosphates and carbonates.

The use of a mixture of iron and cobalt, added as ferric nitrate and cobalt nitrate, is preferred. Use of this mixture is economical and results in a good combination of corrosion resistant and paint adherent properties while producing a coating of brown color that is readily visible.

The surface properties of a zinc surface can be modified by the use of a coating solution containing as little as about 0.01 g/l of dissolved metal. Preferably, the coating solution should contain at least about 0.2 g/l of the metal in the solution. The metal can be present in the solution in amounts up to its solubility limit which will depend on other parameters of the coating solution, including particularly, the alkalinity of the coating solution and the amount of complexing agent. In general, satisfactory results can be obtained by using up to about 1 g/l of metal in that the use of larger amounts does not generally result in any appreciable improvement in desired properties.

As to the complexing agent, any compound soluble in the solution can be used. The use of an alkali metal pyrophosphate is preferred, but other sources of pyrophosphate can be used, for example, pyrophosphoric acid and ammonium pyrophosphate.

Nitrilotriacetic acid, as well as salts of the acid can be used.

The complexing agent should be present in an amount at least sufficient to maintain the metal constituents of the composition in solution. Accordingly, the specific amount of complexing agent used will be dependent on the amount of metal that needs to be complexed. It is noted that in a continuous process in which coating solution is recycled for use, there will be a build-up in the coating solution of zinc inasmuch as the coating solution effects dissolution of the zinc surface. The zinc can build up in concentration to the extent that it precipitates from solution if steps are not taken to prevent this. Precipitation of zinc or other metal from the composition is undesirable because it can lead to the formation of sludge which can clog equipment, and in the case of constituents needed for coating formation, essential constituents of the bath are depleted.

Although steps can be taken to remove dissolved zinc from solution in a manner such that there is no interference with the coating process, it is preferred to add to the solution sufficient complexing agent to complex the zinc and maintain it in dissolved form.

It has been observed that excessive amounts of the complexing agent can have an adverse effect on coating formation. It is recommended that the pyrophosphate be present in an amount not exceeding about 25 g/l, and that the organic complexing agent be present in an amount not exceeding about 10 g/l.

One of the significant advantages of this invention is that a make-up bath of the preferred composition can be prepared from but three ingredients, namely water, the source of the metal and an alkali metal pyrophosphate. Utilizing these three ingredients, the pH of the make-up composition can be within the desired range, that is, in excess of 7 and up to about 10.2. It has been observed that the composition can be used to form coatings at pH's in excess of about 10.2, for example, up to about 10.8 or even somewhat higher, but at pH's of about 10 or higher, problems are encountered in prolonged use of the composition, and the problems become more severe as the pH is increased. Basically, the problem at the higher pH's is one of stability of the bath, and accordingly, it is recommended and preferred that the pH of the composition be no greater than about 10. As to a preferred minimum pH, a pH of about 9.4 is recommended, and a preferred pH range is about 9.4 to about 9.6. The lower the pH, the slower the rate of coating formation. Operating within the preferred pH range, a good rate of coating formation can be achieved without encountering sludge formation or other type of stability problem.

The success achieved by operating at pH's described above are surprising and unexpected in that the aforementioned Maurer and Shah patent discloses that at a pH below about 11, the rate of coating formation, which is dependent on time and temperature, is not as good as that achieved when operating at higher pH's.

Compositions within the scope of the present invention can be used to form coatings which range in color from gray to brown, depending on the particular composition used. By way of example, it is noted that the use of a particular iron-containing composition produced a brown colored coating, a particular nickel-containing composition produced a gold colored coating, a particular cobalt-containing composition produced a blue-gray coating and a tin-containing composition produced a coating light gray in color. In combining iron with nickel, the color of the coating was intensified and the coatings were more uniform in color. Iron combined with cobalt appeared to produce a darker color than when either iron or cobalt was used alone.

In an industrial operation which can involve the treatment of vast quantities of zinc in a relatively short time, it is helpful to have a simple way of confirming the formation of a coating. The colored coatings formed from solutions of the present invention provide this.

With respect to optional ingredients, it has been observed that an increase in the rate of coating formation can be realized by including in the composition a reducing agent. The reducing agent should be stable in the composition and also in any concentrate from which a bath of coating solution is prepared. Good results have been obtained utilizing sulphite, for example, sodium sulphite or other alkali metal sulfite, or ammonium sulfite. Other examples of reducing agents that can be used are hydro sulfite and meta bisulfite, for example, sodium, potassium or ammonium forms thereof.

The reducing agent should be used in an amount equivalent to about 1 to about 10 g/l of sodium sulfite.

The coating solution of the present invention can be prepared conveniently by diluting an aqueous concentrate of the ingredients with an appropriate amount of water. The concentrate should have a pH of about 9.5 to about 10.4 and it should be such that when a coating solution comprises about 5 to about 25 volume percent of the concentrate, the amounts of ingredients present in the coating solution are: (A) at least about 0.01 g/l of cobalt, nickel, iron or tin, or a mixture thereof; and (B) sufficient complexing material to maintain the metal in solution. A concentrate for preparing a preferred coating solution has a pH of about 9.5 to about 10.4 and is such that when the coating solution comprises about 5 to about 25 volume percent of the concentrate, the coating solution comprises: about 0.1 to about 10 g/l of ferric nitrate·$9H_2O$, about 0.01 to about 10 g/l of cobalt nitrate·$6H_2O$, and about 1 to about 100 g/l of tetra potassium pyrophosphate.

In a continuous coating operation, including one in which recycled solution is used, it is important to replenish the solution properly in order to maintain its effectiveness. Work done in connection with the development of the present invention has shown that as the solution is used, the pH rises and that various of the ingredients comprising the solution are depleted as a result of reactions which occur during the formation of the coating. As to the rise in pH, this dictates that the replenishment include adding to the solution materials which are less alkaline. Analysis has shown also that metal ion is consumed during the coating process and that zinc is dissolved from the surface as coating is formed. Thus, monitoring pH and metal content can be used as a basis for determining the type of replenishment that is needed. It should be appreciated also that ingredients are depleted as the result of drag-out of the solution on the zinc surface.

Work has shown that replenishment can be effected by the use of a single composition containing the ingredients needed for replenishment. In an application in which there is build-up of zinc in the coating solution, it is recommended that the replenishing composition contain sufficient complexing agent for complexing the zinc. Typically, the pH of the replenishing composition will be in the neighborhood of about 7. In this pH range, pyrophosphate is effective in maintaining nickel and/or tin in solution, but problems can be encountered when cobalt and/or iron is present in the composition in that either of these metals tend to precipitate in this pH range. Accordingly, the use of another complexing agent that is more effective in maintaining cobalt and/or iron in solution at a pH in the neighborhood of 7 is recommended. Good results have been achieved by using, in combination with pyrophosphate, an organic material which is effective in complexing cobalt and/or iron at a pH of about 6.8 to about 7.2. A preferred organic complexing agent is nitrilotriacetic acid.

A replenishing composition for use in the practice of the invention comprises: about 1 to about 10 g/l of dissolved metal; about 10 to about 100 g/l of dissolved inorganic complexing agent; optionally about 5 to about 20 g/l of organic complexing agent; and sufficient alkali to impart to the composition a pH of about 6.8 to about 7.2. The replenishing composition is added as needed to maintain the pH in the desired range.

A description of other steps that can be utilized in the overall coating process follows.

The coating solution should be applied to a clean zinc surface. Available cleaning compositions such as alkaline or acidic cleaning solutions can be used to clean the zinc surface according to conventional techniques. A water rinse after cleaning can be used to remove residual cleaning solution.

The coating solution can be applied to the zinc by any suitable method. For example, the solution can be applied by spraying the surface, or the zinc surface can be immersed in the solution, or it can be applied by roll or flow coating techniques or misting techniques. It is believed that the solution can be applied very economically by spraying. The solution can be used to coat individual articles such as, for example, automobile and appliance parts, or it can be used to coat forms of zinc, such as galvanized steel coil which subsequently is fabricated into articles.

The temperature of the coating solution should be such that the reactive ingredients of the solution bond to the zinc surface at a satisfactory rate. In general, the temperature of the coating solution should be at least about 100° F. An upper temperature of about 160° F. is recommended. The temperature of the coating solution is preferably within the range of about 120° F. to about 140° F.

Desired coatings can be formed by contacting the coating solution and the zinc surface for at least about 5 seconds, preferably at least about 15 seconds. The lower the temperature of the coating solution, the longer the contact time should be, and the higher the temperature of the solution the shorter the contact time required. In general, it will be unnecessary to contact the surface with the coating solution for more than about one minute.

The corrosion resistant properties of the coated surface can be improved by contacting the wet coated surface with an acidic aqueous solution containing hexavalent chromium. Such solutions, which are well known, as are their application conditions, can be prepared from chromium trioxide or a water soluble dichromate or chromate salt, for example, ammonium, sodium and potassium salts. There can be used also a chromium composition obtained by treating a concentrated aqueous solution of chromic acid with formaldehyde to reduce a portion of the hexavalent chromium. This type of rinse composition, which is described in U.S. Pat. No. 3,063,877 to Schiffman, contains chromium in its hexavalent state and reduced chromium in aqueous solution. By way of example, such an aqueous rinse composition can comprise a total chromium concentration within the range of about 0.15 g/l (expressed as $CrO_3$) to about 2 g/l, wherein from about 40–95% of the chromium is in its hexavalent state and the remainder of the chromium is in its reduced state.

The mere presence of hexavalent chromium in the post-treatment solution appears to improve the corrosion resistant properties of the coating, with increasing amounts giving increased improvements. However, it is recommended that at least about 0.01 g/l of hexavalent chromium be used and that the amount be adjusted upwardly as required, if necessary.

The coated surface can be subjected to sanitary or decorative coating operations which include, for example, applying to the coated surface siccative coatings. These coatings are usually applied after the zinc surface has been coated and dried.

It has been observed that the coating composition of the present invention does not form on the zinc surface a measurable coating. It can be characterized as an amorphous chemical conversion coating. Analysis of a coating formed from a solution containing pyrophosphate complexing agent showed an absence of phosphorous in the coating.

Inasmuch as the coating solution is alkaline, it is capable of being used as a cleaner to remove from a metal surface soil of the type that is generally removed by alkaline cleaning materials. Thus, there are applications where the composition of the present invention can be used to clean and coat simultaneously a zinc surface.

EXAMPLES

Examples below are illustrative of the invention.

Unless stated otherwise, each of the Zn surfaces treated with the compositions identified in the examples was a zinc panel of hot-dipped galvanized steel, 4" by 12" in size, which was subjected to the following sequence of steps:

(A) spray cleaned with an aqueous alkaline cleaning solution for 20 seconds at 160° F. (71° C.);
(B) rinsed with a cold water spray for 2 to 3 seconds at ambient temperature;
(C) treated with a composition of the examples at a temperature of 125° F. (52° C.) by immersing in a laboratory immersion cell for 15 seconds;
(D) rinsed with a cold water spray for 2 to 3 seconds at ambient temperature;
(E) treated with a 0.5 wt. % $Cr^{+6}$/reduced Cr aqueous solution sold under the trademark Deoxylyte 41 by Amchem Products, Inc. by immersing for 5 seconds, followed by squeegeeing through wringer rolls and air drying; and
(F) painted with a single coat of polyester paint, manufactured by Hanna Chemical Coatings Corp. identified as CWS 9039, to a paint film thickness of about 0.8–1 mil, followed by baking for 75 seconds in an oven having a temperature of 500° F. (260° C.) to a peak metal temperature of 420° F. (216° C.) and then quenching in cold water.

The degree of adherence of the paint film to the underlying treated surface and its degree of resistance to corrosion were evaluated by subjecting panels to tests used in industry to evaluate such properties.

Corrosion resistant properties were evaluated by subjecting painted panels to salt spray conditions in accordance with ASTM B 117.

A test referred to herein as "T-Bend" was used to evaluate paint adhesion. The test involves making an overlapping 180° bend on the painted panel—in effect rolling the panel up on itself. After the initial bend is made, cellophane tape (sold under the trademark Scotchbrand No. 610) is applied parallel to and over the bend, and then removed. The tape is then inspected to determine the amount of paint adhering to the tape. If none appears, the evaluation is completed and the paint adherent properties of the treated surface are considered excellent. However, if paint adheres to the tape, the next bend is made, tape applied, removed and examined as described, and the procedure followed until no paint appears on the tape. It should be appreciated that the initial bend is the bend at which paint loss is most apt to be encountered. As the results of the test are reported at the first T-bend at which no paint loss occurs, the lower the T-bend rating, the better the paint adherence. In general, a rating of 1 or 2 is considered excellent and a rating of 4 or more is considered poor.

The first group of examples shows the use of a treating composition within the scope of this invention and comprising an alkaline solution of 25 g/l of $K_4P_2O_7$ and 2.5 g/l of $Fe(NO_3)_3.9H_2O$, and the use of modified forms of this composition. The modification encompassed including in the composition amounts of $Co(NO_3)_2.6H_2O$ as indicated in Table 1 below, which sets forth also the pH of the treating compositions and the results of paint adhesion tests. In this group of examples, the paint used was an acrylic paint sold under the trademark Durocron 630 and the thickness of the dry paint film was about 0.5 mil.

TABLE 1

| Ex. No. | COMP. INCL. $Co(NO_3)_2 . 6H_2O$, g/l | pH | Paint Adhesion, number of T-Bends |
|---|---|---|---|
| 1 | — | 10.2 | 2 |
| 2 | 0.1 | 10.0 | 2 |
| 3 | 0.2 | 10.0 | 2 |
| 4 | 0.5 | 9.9 | 2 |

TABLE 1-continued

| Ex. No. | COMP. INCL. $Co(NO_3)_2 . 6H_2O$, g/l | pH | Paint Adhesion, number of T-Bends |
|---|---|---|---|
| 5 | 1 | 9.8 | 3 |
| 6 | 2 | 9.8 | 2 |

It was observed that the salt spray corrosion resistance of the coated panels increased proportionately to the cobalt concentration up to 0.5 g/l $Co(NO_3)_2.6H_2O$. Beyond that concentration, no further increase in corrosion resistance was evident. The color did, however, increase as the cobalt concentration increased to the limit tested.

The next group of examples shows the use of a treating composition within the scope of this invention and comprising an aqueous alkaline solution of 25 g/l of $K_4P_2O_7$ and 0.5 g/l of $Co(NO_3)_2.6H_2O$, and the use of modified forms of this composition. The modification encompassed including in the composition amounts of $Fe(NO_3)_3.9H_2O$ as indicated in Table 2 below, which sets forth also the pH of the treating compositions and the results of paint adhesion tests.

TABLE 2

| Ex. No. | COMP. INCL. $Fe(NO_3)_3 . 9H_2O$, g/l | pH | Paint Adhesion, number of T-Bends |
|---|---|---|---|
| 7 | — | 10.3 | 2 |
| 8 | 0.1 | 10.2 | 2 |
| 9 | 0.2 | 10.1 | 4 |
| 10 | 0.5 | 10.0 | 3 |
| 11 | 1 | 9.9 | 2 |
| 12 | 2.5 | 9.7 | 2 |
| 13 | 5 | 9.35 | 2 |

It was observed that the salt spray corrosion resistance and paint adhesion increased to a maximum at a concentration of about 1 g/l $Fe(NO_3)_3.9H_2O$.

The next group of examples shows the use of treating compositions within the scope of this invention and comprising an aqueous alkaline solution of 1 g/l of $Fe(NO_3)_3.9H_2O$ and 0.5 g/l of $Co(NO_3)_2.6H_2O$, and various amounts of $K_4P_2O_7$ as indicated in Table 3 below, which sets forth also the pH of the treating compositions and the results of paint adhesion tests.

TABLE 3

| Ex. No. | COMP. INCL. $K_4P_2O_7$, g/l | pH | Paint Adhesion, number of T-Bends |
|---|---|---|---|
| 14 | 5 | 9.35 | 2 |
| 15 | 10 | 9.7 | 2 |
| 16 | 15 | 9.85 | 3 |
| 17 | 25 | 10.0 | 3 |
| 18 | 30 | 10.05 | 3 |
| 19 | 40 | 10.1 | 3 |
| 20 | 60 | 10.3 | 2 |
| 21 | 80 | 10.35 | 2 |

It was observed that paint adhesion was at a maximum at a concentration of 10 g/l of $K_4P_2O_7$. Salt spray corrosion resistance was excellent and did not vary significantly with the $K_4P_2O_7$ concentration. It was noted, however, that the intensity of the color of the coating decreased as the concentration of $K_4P_2O_7$ increased.

The next group of examples shows the use at different temperatures of a treating composition within the scope of the invention to coat zinc panels. The temperatures used are identified in Table 4 below, as are also the results of paint adherent tests and the extent to which the panels lost weight as a result of contact with the composition. The treating composition comprised an aqueous alkaline solution containing about 10 g/l of $K_4P_2O_7$, about 1 g/l of $Fe(NO_3)_3.9H_2O$, and about 0.5 g/l of $Co(NO_3)_2.6H_2O$ and having a pH of about 9.7.

TABLE 4

| Panel Series | Temp., °F. (°C.) | Paint Adhesion, T-Bend | Zn loss, mg/ft$^2$ |
|---|---|---|---|
| 1 | 80 (27° C.) | 3 | 10.6 |
| 2 | 100 (38° C.) | 3 | 12.2 |
| 3 | 120 (49° C.) | 3 | 14.0 |
| 4 | 140 (60° C.) | 3 | 10.0 |
| 5 | 160 (71° C.) | 3 | 13.0 |
| 6 | 180 (82° C.) | 3 | 13.4 |

It was observed that salt spray corrosion resistance was proportional to the Zn weight loss. At 120° F., the corrosion resistance and Zn weight loss was at a maximum.

The next group of examples shows the preparation of a concentrate from which there can be made a treating composition of the present invention, the use of a bath of the composition to treat zinc panels, and the replenishment of the bath with a replenishing composition within the scope of the present invention.

The concentrate contained the following and had a pH of about 7.

| Concentrate | | | |
|---|---|---|---|
| Constituents | | g/l | |
| $K_4P_2O_7$ | $K_4P_2O_7$ | 100 | 100 |
| $Co(NO_3)_2 . 6H_2O$ | | 5 | |
| $Fe(NO_3)_3 . 9H_2O$ | | 10 | |
| Water | | 969 | |

A 2-liter bath of treating composition containing 10% by volume of the concentrate was prepared by diluting the concentrate with water. Accordingly, the make-up bath contained 10 g/l of $K_4P_2O_7$, 0.5 g/l of $Co(NO_3)_2.6H_2O$ and 1 g/l of $Fe(NO_3)_3.9H_2O$. To replenish this bath as it was used to coat zinc panels, the following replenisher was prepared.

| Replenisher | |
|---|---|
| Constituents | g/l |
| $Na_2H_2P_2O_7$ | 25 |
| nitriltriacetate, disodium salt | 5 |
| $Co(NO_3)_2 . 6H_2O$ | 6 |
| $Fe(NO_3)_3 . 9H_2O$ | 9 |
| aqueous solution of Na(OH), 50 wt. % | 12.6 |
| water | 974.4 |

Reference is made to Table 5 below which, in effect, summarizes the manner in which the bath was used and replenishment thereof.

TABLE 5

| | Conc, ppm | | | |
|---|---|---|---|---|
| | pH | Co | Fe | Zn |
| bath make-up | 9.80 | 110 | 153 | 0 |
| process 25 panels | 9.9 | | | |
| added 16.7 ml replenisher | 9.80 | 108 | 152 | 57 |
| processed an additional 25 panels (total 50) | 9.92 | | | |
| added 16.7 ml replenisher | 9.78 | 110 | 153 | 101 |

TABLE 5-continued

| | Conc, ppm | | | |
|---|---|---|---|---|
| | pH | Co | Fe | Zn |
| processed an additional 25 panels (total 75) | 10.06 | | | |
| added 16.7 ml replenisher | 9.85 | 108 | 153 | 153 |
| processed an additional 25 panels (total 100) | 9.95 | | | |
| added 16.7 ml replenisher | 9.78 | 110 | 153 | 190 |
| processed an additional 25 panels (total 125) | 9.96 | | | |
| added 16.7 ml replenisher and also added 100 ml of the composition used to make up the bath to replace drag-out | 9.78 | 113 | 153 | 217 |
| processes an additional 25 panels (total 150) | 9.98 | | | |
| added 16.7 replenisher | 9.77 | 115 | 155 | 247 |
| processed an additional 25 panels (total 175) | 10.00 | | | |
| added 16.7 ml replenisher | 9.80 | 117 | 160 | 273 |
| processed an additional 25 panels (total 200) | 10.00 | 110 | 150 | 300 |
| added 16.7 ml replenisher | 9.80 | 120 | 160 | 300 |

During the coating of 200 panels, the bath remained free of sludge and other precipitate.

The next and last group of examples shows the use of treating compositions within the scope of this invention and including a reducing agent. The several compositions that were formulated included sodium sulfite as the reducing agent in the amounts indicated in Table 6 below. In addition to the reducing agent, each of the compositions contained 25 g/l of $K_4P_2O_7$, 2.5 g/l of $Fe(NO_3)_3.9H_2O$ and 2.5 g/l of $Ni(NO_3)_3.6H_2O$.

TABLE 6

| Ex. No. | Amount of $Na_2SO_3$ g/l |
|---|---|
| 22 | 1 |
| 23 | 2 |
| 24 | 5 |
| 25 | 10 |
| 26 | 20 |
| 27 | 50 |

In utilizing the composition of Example 22 of Table 6 above, it was observed that the coating that was formed on a hot-dipped galvanized steel panel was substantially darker in color than a coating formed on a like panel utilizing a composition alike in all respects to the composition of Example 22 except for the absence of sodium sulfite. The darker the color, the greater the amount of coating, and this is an indication of a higher rate of coating formation inasmuch as each of the panels was treated with the composition for the same amount of time (15 seconds). It was observed also that the use of increased amounts of sodium sulfite resulted in darker colors up to a concentration of 10 g/l of sodium sulfite. At this concentration, the coating was somewhat lighter than the coating that was formed from the composition which included 5 g/l of sodium sulfite. The use of the compositions of Examples 26 and 27 produced coatings which were about the same in color as that of the coating formed from the composition of Example 25.

In summary, it can be stated that the present invention provides the means for forming high quality coatings while avoiding several major problems and disadvantages encountered in the use of heretofore known compositions.

I claim:

1. An aqueous alkaline coating solution which is effective in forming corrosion-resistant coatings on surfaces of zinc or alloys of zinc, said solution having a pH of no greater than about 10.2 and consisting essentially of one or more of the following metals in solution: cobalt, nickel, iron and tin, the total amount of said metal or mixture of said metals in the solution being about 0.01 to about 1 g/l; and a complexing material in an amount effective to maintain the metal in solution, said complexing material being selected from the group consisting of pyrophosphate, nitrilotriacetic acid, a salt of nitrilotriacetic acid, and a mixture of two or more of said complexing materials.

2. A coating solution according to claim 1 wherein said complexing material is pyrophosphate.

3. A coating solution according to claim 2 including an alkali metal pyrophosphate.

4. A coating solution according to claim 1 including a reducing agent.

5. A coating solution according to claim 4 wherein the reducing agent is a sulfite.

6. An aqueous alkaline coating solution which is effective in forming corrosion-resistant coatings on surfaces of zinc or alloys thereof, said solution having a pH of no greater than about 10.2 and consisting essentially of a metal, namely cobalt, nickel, iron, or tin, or a mixture of two or more of said metals, said metal or mixture being present in the solution at a concentration of about 0.01 to about 1 g/l, and a pyrophosphate complexing agent, said complexing agent being present at a concentration of no greater than about 25 g/l.

7. A solution according to claim 6 wherein the amount of said metal or mixture is about 0.2 to about 1 g/l, the amount of said complexing agent is no greater than about 10 g/l and the pH of the solution is about 9.4 to about 9.6.

8. A solution according to claim 6 including sulfite in an amount equivalent to about 1 to about 10 g/l of sodium sulfite.

9. An aqueous concentrate having a pH of about 9.5 to about 10.4 and being such that an aqueous coating solution containing about 5 to about 25 volume percent of the concentrate consists essentially of: (A) about 0.01 to about 1 g/l of cobalt, nickel, iron or tin, or a mixture of two or more of said metals; and (B) a complexing material selected from the group consisting of pyrophosphate, nitrilotriacetic acid, a salt of nitrilotriacetic acid, and a mixture of two or more of said complexing materials, said complexing material being present in an amount effective to maintain the metal in solution, and wherein said coating solution is effective in forming a corrosion-resistant coating on surfaces of zinc or alloys of zinc.

10. An aqueous concentrate having a pH of about 9.5 to about 10.4 and being such that an aqueous coating solution containing about 5 to about 25 volume percent of the concentrate consists essentially of: about 0.1 to about 10 g/l of ferric nitrate·$9H_2O$, about 0.01 to about 10 g/l of cobalt nitrate·$6H_2O$, and about 1 to about 100 g/l of tetra potassium pyrophosphate.

11. A replenishing composition for use in replenishing an aqueous alkaline coating solution, which solution is effective in forming a corrosion-resistant coating on surfaces of zinc or alloys of zinc, said composition having a pH of about 6.8 to about 7.2 and consisting essentially of about 1 to about 10 g/l of dissolved cobalt, nickel, iron or tin, or a mixture of of two or more of said metals and about 10 to about 100 g/l of dissolved inorganic complexing agent, said complexing agent being a pyrophosphate.

12. A composition according to claim 11 including cobalt or iron or a mixture thereof and about 5 to about 20 g/l of an organic complexing agent selected from the group consisting of nitrilotriacetic acid and a salt thereof.

13. A composition according to claim 12 wherein the organic complexing agent is nitrilotriacetic acid.

14. A composition according to claim 11 wherein said inorganic complexing agent is an alkali metal pyrophosphate.

15. An aqueous alkaline coating solution which is effective in forming a corrosion-resistant coating on surfaces of zinc or alloys of zinc, said solution consisting essentially of about 5 to about 25 g/l of $K_4P_2O_7$, and a metal compound selected from the group consisting of $Fe(NO_3)_3.9H_2O$, $Co(NO_3)_2.6H_2O$ and mixtures thereof, and wherein the concentration of said $Fe(NO_3)_3.9H_2O$ is from about 0.1 to about 5 g/l and the concentration of said $Co(NO_3)_2.6H_2O$ is from about 0.1 to about 2.5 g/l.

16. The coating solution of claim 15 wherein the $Fe(NO_3)_3.9H_2O$ is present in solution at about 1 g/l, the $Co(NO_3)_2.6H_2O$ is present in solution at about 0.5 g/l and the $K_4P_2O_7$ is present in solution at about 10 g/l.

17. The coating solution of claim 15 including about 1 to about 50 g/l of sodium sulfite.

18. A process for treating a zinc surface comprising forming thereon a coating by contacting said surface with a solution according to claim 1, 2, 3, 4, 5, 6, 7, 8, 15, 16 or 17.

* * * * *